United States Patent [19]

Shibuya et al.

[11] Patent Number: 4,977,949

[45] Date of Patent: Dec. 18, 1990

[54] APPARATUS FOR TRANSFERRING RAPIDLY QUENCHED METALLIC TAPES

[75] Inventors: Kiyoshi Shibuya; Toru Sato; Nobuyuki Morito; Seiko Nara; Teruo Hiramatsu, all of Chiba, Japan

[73] Assignee: Kawasaki Steel Corporation, Kobe, Japan

[21] Appl. No.: 444,030

[22] Filed: Nov. 30, 1989

Related U.S. Application Data

[63] Continuation-in-part of Ser. No. 422,776, Oct. 17, 1989.

[30] Foreign Application Priority Data

Dec. 10, 1988 [JP] Japan ..... 63-311023

[51] Int. Cl.[5] ..... B22D 11/06

[52] U.S. Cl. ..... 164/417; 164/423; 164/483

[58] Field of Search ..... 164/477, 417, 423, 463, 164/429, 479, 483

[56] References Cited

FOREIGN PATENT DOCUMENTS 60-87958 5/1985 Japan ..... 164/463

60-118360 6/1985 Japan ..... 164/477

*Primary Examiner*—Kuang Y. Lin

*Attorney, Agent, or Firm*—Dvorak and Traub

[57] ABSTRACT

An apparatus for transferring a rapidly quenched metallic tape, which is produced by solidification through rapid quenching on a circumferential surface of a single cooling roll rotating at a high speed, from the cooling roll into a winder, comprises a transfer means provided with a pinch roll unit for catching and feeding out the peeled metallic tape, a fan for breaking and discharging the metallic tape fed out from the pinch roll unit, and a dust device for recovering metallic pieces and powder generated in the breakage of the metallic tape by the fan.

2 Claims, 2 Drawing Sheets

APPARATUS FOR TRANSFERRING RAPIDLY QUENCHED METALLIC TAPES

This application is a continuation-in-part of the copending application Ser. No. 422,776 filed Oct. 17, 1989.

BACKGROUND OF THE INVENTION

1. Field of the Invention

This invention relates to an apparatus for guiding and transferring a rapidly quenched metallic tape (referred to as a metallic tape hereinafter), particularly an amorphous metallic tape produced by a single roll method, from a cooling roll to a winder.

2. Related Art Statement

Recently, it has been investigated and developed to produce metallic tapes directly from molten metals (including alloys) by rapidly liquid quenching methods such as a single roll method and a twin roll method. In carrying out these methods, the producing technique itself may of course be important to determine surface configurations and uniformity in thickness of the metallic tapes. However, in the production of the metallic tapes on industrial scale, it is needed to accomplish handling of produced metallic tapes or technique for winding the metallic tapes into coils.

In case of crystalline metallic tapes having thickness of not less than 100 μm, feeding speeds of the tapes are usually not more than 5 m/sec by a limitation resulting from solidification due to heat transfer to a cooling element. Therefore, such metallic tapes can be transferred by a mesh belt having a clamper and taken up by winding by a heat-resistant belt wrapper as proposed in Japanese Patent laid open No. 61-88,904.

In case of amorphous metallic tapes, on the other hand, the thickness is very thin as not more than 50 μm and the feeding speed of the tape is not lower than 20 m/sec, so that means disclosed in the above Japanese Publication could not be applied without any modifications. With the amorphous metallic tapes, moreover, the characteristics of the materials tend to change depending upon producing speeds so that mechanical strengths are often spoilt. Therefore, it is more difficult to accomplish taking-up technique because the producing speed could not be changed in taking up on a reel and taking off.

It has been proposed to wind an amorphous metallic tape onto a take-up reel having a magnet embedded therein arranged closely adjacent a cooling roll in Japanese Patent laid open No. 57-94,453 and Japanese patent application publication No. 59-34,467. This method is dexterous in arranging the take-up reel closely adjacent the cooling roll to eliminate the troublesome transferring of the tapes. However, as the reel is close to the cooling roll, it is not necessarily suitable for continuous production of the tapes. Moreover, it is not suitable for industrial production on a large scale, for lack of spaces for providing inspection devices for thicknesses and apertures of tapes and control device for tensile forces on the tapes.

In order to avoid these disadvantages, proposals for positively accomplishing the transfer technique by arranging winders remote from cooling rolls have been disclosed in Japanese patent laid open Nos. 56-12,257, 59-43,772 and 59-138,572 and Japanese patent application No. 62-290,477. In these techniques, it has been proposed to use suction devices, brush rolls or brush-solid roll pairs and the like as pinch rolls for catching and transferring amorphous metallic tapes.

In the above method, the metallic tape is transferred from the cooling roll to the winder by utilizing the suction device, brush rolls or brush-solid roll pairs placed on a transfer trolley as a pinch roll for catching the amorphous alloy tape or the like. In many cases, the running speed of the transfer trolley is remarkably lower than the feeding speed of the metallic tape or the revolution speed of the cooling rolls, so that before the transfer trolley arrives at the position of the winder and further the metallic tape is taken up on the reel of the winder, the resulting long metallic tape passes through the pinch roll and is scattered around the transfer line ranging from the cooling roll to the winder. As a result, not only the surroundings of the apparatus is spoilt, but also the running of the transfer trolley itself is obstructed, so that this phenomenon comes into a serious problem.

However, these problems are not mentioned in articles reported on the apparatus for the manufacture of metallic tapes such as amorphous alloy tape and the like up to date.

SUMMARY OF THE INVENTION

It is an object of the invention to provide an apparatus capable of removing an extra end portion of the resulting metallic tape from the transfer line during the transportation of the metallic tape from the cooling roll to the winder.

According to the invention, there is the provision of an apparatus for transferring a rapidly quenched metallic tape, in which the rapidly quenched metallic tape produced by solidification through rapid quenching on a circumferential surface of a single cooling roll rotating at a high speed is peeled off from the cooling roll and guided into a winder, characterized in that a transfer means provided with a pinch roll unit for catching and feeding out the peeled metallic tape and a fan for breaking and discharging the metallic tape fed out from the pinch roll unit is movably arranged on a line ranging from the cooling roll through the winder behind the winder, and further a dust device for recovering metallic pieces and powder generated in the breakage of the metallic tape by the fan is arranged in the apparatus.

In a preferred embodiment of the invention, the dust device is provided with a duct disposed behind the fan, a dust box arranged at a terminal of the duct and provided with a filter and a suction means for forcedly introducing the metallic pieces and powder into the dust box, and the duct is movably arranged together with the transfer means.

BRIEF DESCRIPTION OF THE DRAWINGS

The invention will be described with reference to the accompanying drawings, wherein.

DESCRIPTION OF THE PREFERRED EMBODIMENTS

Figure 1:
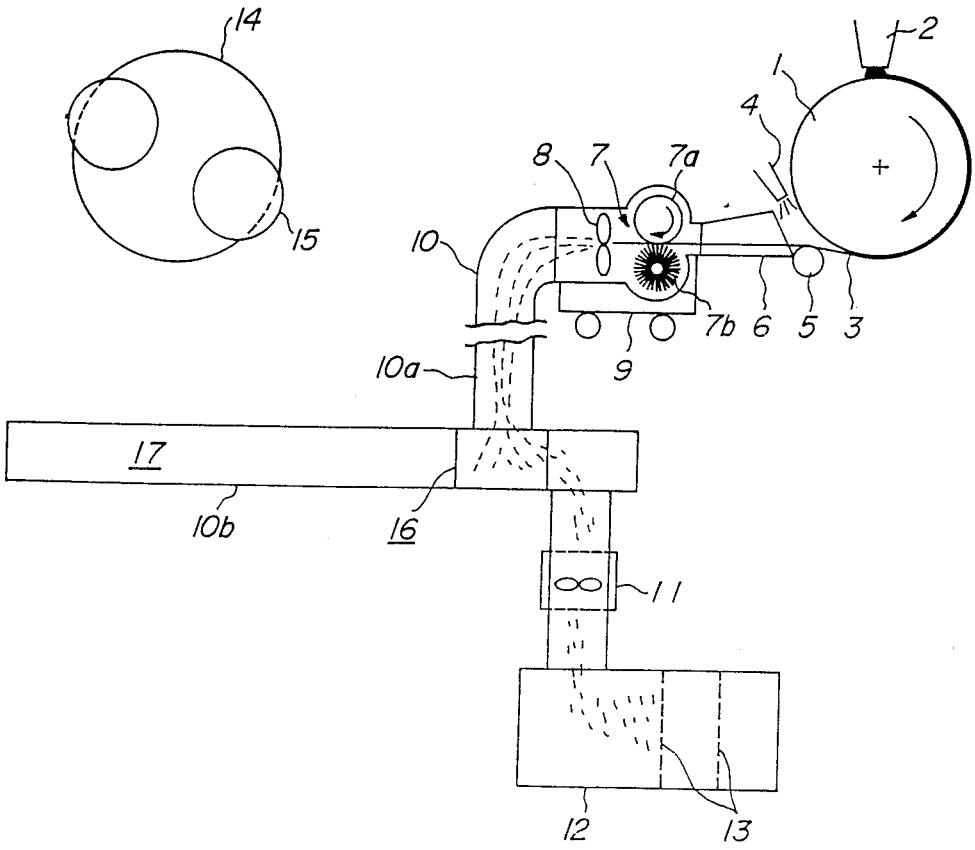
FIG. 1 is a schematic view illustrating the apparatus for transferring the metallic tape according to the invention.

In FIG. 1 is shown an apparatus for transferring the rapidly quenched metallic tape according to the invention. Numeral 1 is a cooling roll, numeral 2 a pouring nozzle for supplying molten metal onto the circumference of the cooling roll 1, numeral 3 a rapidly quenched metallic tape, numeral 4 an air knife for peeling off the metallic tape 3 from the cooling roll 1 through the jetting of air, numeral 5 a deflector roll, numeral 6 a transfer guide provided with a suction port directing to the cooling roll 1, numeral 7 a pinch roll unit arranged behind the transfer guide 6 and consisting of a solid roll 7*a* and a brush roll 7*b*, numeral 8 a fan for breaking the metallic tape 3 arranged downstream the pinch roll unit 7, numeral 9 a transfer trolley conducting movement of the pinch roll unit 7 and the fan 8, numeral 10 a duct as a passage of metallic pieces broken by the fan 8, numeral 11 a suction blower for guiding the metallic pieces by suction, numeral 12 a dust box provided with a filter 13, numeral 14 a winder, and numeral 15 a take-up reel.

According to the invention, the transfer means is comprised of the pinch roll unit 7, fan 8 and transfer trolley 9, and the dust means is comprised of the duct 10, suction blower 11 and dust box 12, and the duct 10 connecting the transfer means to the dust means is movably arranged in accordance with the movement of the transfer means.

Figure 2:
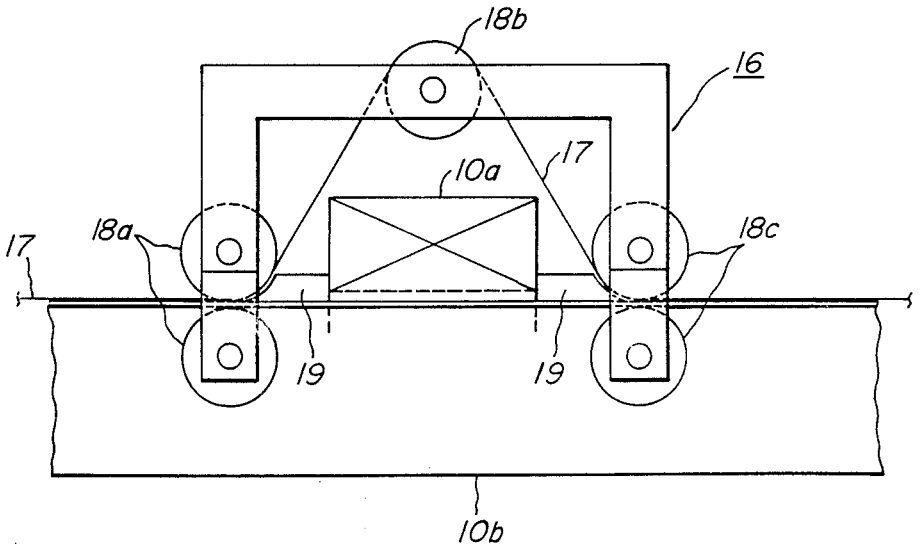
FIG. 2 is a schematic view showing a structure of the connecting means used in the apparatus according to the invention.

That is, the duct 10 is constructed by connecting a moving duct member 10*a* to a fixed duct member 10*b* through a connecting means 16 having a structure shown in FIG. 2. In this case, the upper face opening of the fixed duct member 10*b* is covered with a sealing plate 17 to give an air tightness, while the metallic pieces are introduced into the dust box 12 by air discharge through the suction blower 11. The top of the movable duct member 10*a* is arranged from the side of the fixed duct member 10*b* on the upper face opening of the fixed duct member 10*b* and covered with the sealing plate 17 guided by three seal rolls 18*a*, 18*b* and 18*c* to hold the air tightness. Furthermore, in order to airtightly maintain the movable duct member 10*a* and the sealing plate 17, a pair of sliding plates 19 made from teflon, nylon or the like are disposed on both sides of the movable duct member 10*a*.

Thus, the movable duct member 10*a* is made possible to run on the fixed duct member 10*b* by the connecting means 16 having the above structure while maintaining the air tightness.

The procedure of mainly recovering the end portion of the metallic tape through the transferring apparatus according to the invention will be described below.

The metallic tape 3 prepared by solidification through rapid quenching on the surface of the cooling roll 1 rotating at a high speed is peeled off from the cooling roll 1 with the air knife 4 and guided into the transfer guide 6, at where the metallic tape 3 is caught by the pinch roll unit 7 placed on the transfer trolley 9. Moreover, a high speed air stream is formed inside the transfer guide 6 by means of the fan 8 arranged behind the pinch roll unit 7. This fan 8 acts to break the metallic tape and transfer it by air discharge. On the other hand, the deflector roll 5 functioning to form an adequate pass line when tension is applied to the metallic tape is arranged at the entrance side of the transfer guide. The movable duct member 10*a* arranged behind the fan 8 is communicated to the fixed duct member 10*b* through the runnable connecting means 16, while the fixed duct member 10*b* is communicated to the dust box 12 through the suction blower 11 having a large suction force. In the dust box 12 are arranged the filters 13, whereby only pieces and powder of the broken metallic tape are recovered in the dust box 12.

Thus, the metallic pieces recovered in the dust box 12 can be reused as a starting material for the production of alloy powder, alloy flake and the like.

The steps of transferring the resulting metallic tape to the winder and coiling it thereon will be described in detail by using the transferring apparatus shown in FIG. 1 below.

A molten alloy having a composition of 1 atomic % (hereinafter referred to as "at %") of C, 7 at % of Si, 12 at % of B and the balance being Fe was kept at 1300° C. and ejected onto an upper most portion of a cooling roll 1 made of a copper alloy and rotating at a high speed (25 m/sec) through a slit-like nozzle having a width of 100 mm to produce an amorphous alloy tape 3 having a thickness of 22 μm. As shown in FIG. 1, a high speed air stream of not less than 30 m/sec was formed inside a transfer guide 6 by means of a fan 8 arranged behind a pinch roll unit 7.

Then, the alloy tape 3 peeled off from the cooling roll with an air knife 4 was smoothly introduced into the transfer guide 6. After it was confirmed to pass the alloy tape through an opened state pinch roll unit 7 constituted by a solid roll 7*a* and a brush roll 7*b*, the tape was caught by pressing down the solid roll against the brush roll. The alloy tape 3 introduced and caught inside the transfer guide 6 was broken by means of the fan 8. The pieces of the broken tape were introduced and recovered from the movable duct member 10*a* through the fixed duct member 10*b* and the suction blower 11 into the dust box 12.

Thereafter, a stable tension was given to the alloy tape 3 by means of the pinch roll unit 7 rotating at a speed higher by 2 m/sec than that of the cooling roll 1. Then, the tape 3 was transferred to the winder 14 by moving the transfer trolley 9 together with the pinch roll unit at a speed of 1 m/sec and taken up on the take-up reel 15. During the movement of the transfer trolley 9, the tape passed through the pinch roll unit 7 at a speed of 24 m/sec. However, such a tape was broken by means of the fan 8 and introduced into the dust box 12 from the movable duct member 10*a* through the connecting means 16, the fixed duct member 10*b* and the suction blower 11 having a large suction force. Since the filters 13 were disposed in the dust box 12, only the pieces and powder of the broken tape were recovered in the dust box 12. Thereafter, a portion of the metallic tape other than the tape wound around the take-up reel was completely recovered in the dust box over a period ranging from initial stage of pouring molten metal to transferring and guiding stage, so that there was no fear of spoiling the circumference of the production apparatus with the broken tape.

As mentioned above, according to the invention, when the metallic tape such as amorphous alloy tape or the like is produced by the single roll method, the end portion of the tape other than the tape as a product can completely be recovered as broken pieces, so that the invention has a significant merit in the production technique of metallic tapes.

What is claimed is:

1. An apparatus for transferring a rapidly quenched metallic tape, in which the rapidly quenched metallic tape produced by solidification through rapid quenching on a circumferential surface of a single cooling roll rotating at a high speed is peeled off from the cooling roll and guided into a winder, characterized in that a transfer means provided with a pinch roll unit for catching and feeding out the peeled metallic tape and a fan for breaking and discharging the metallic tape fed out from the pinch roll unit is movably arranged on a line ranging from the cooling roll through the winder toward the rear of the winder, and further a dust device for recovering metallic pieces and powder generated in the breakage of the metallic tape by the fan is arranged in the apparatus.

2. The apparatus according to claim 1, wherein said dust device is provided with a duct disposed behind the fan, a dust box arranged at a terminal of the duct and provided with a filter and a suction means for forcedly introducing the metallic pieces and powder into the dust box, and the duct is movably arranged together with the transfer means.

* * * * *